US012144389B2

(12) United States Patent
Ozaki et al.

(10) Patent No.: US 12,144,389 B2
(45) Date of Patent: Nov. 19, 2024

(54) FLAME-RETARDANT FIBER COMPOSITE AND FLAME-RETARDANT WORKING CLOTHES

(71) Applicant: KANEKA CORPORATION, Osaka (JP)

(72) Inventors: Akira Ozaki, Hyogo (JP); Shinya Nakamura, Hyogo (JP); Keita Uchibori, Osaka (JP); Wataru Mio, Hyogo (JP)

(73) Assignee: KANEKA CORPORATION, Osaka (JP)

( * ) Notice: Subject to any disclaimer, the term of this patent is extended or adjusted under 35 U.S.C. 154(b) by 347 days.

(21) Appl. No.: 17/674,124

(22) Filed: Feb. 17, 2022

(65) Prior Publication Data

US 2022/0167700 A1 Jun. 2, 2022

Related U.S. Application Data

(63) Continuation of application No. PCT/JP2020/029498, filed on Jul. 31, 2020.

(30) Foreign Application Priority Data

Sep. 10, 2019 (JP) ..... 2019-164193

(51) Int. Cl.
*A41D 31/08* (2019.01)
*D02G 3/44* (2006.01)

(52) U.S. Cl.
CPC ..... *A41D 31/08* (2019.02); *D02G 3/443* (2013.01); *D10B 2211/02* (2013.01);
(Continued)

(58) Field of Classification Search
None
See application file for complete search history.

(56) References Cited

U.S. PATENT DOCUMENTS 3,862,070 A 1/1975 Fukushima et al.
4,447,568 A 5/1984 Stern et al.
(Continued)

FOREIGN PATENT DOCUMENTS

EP 0183014 A2 6/1986
GB 1398207 A 6/1975
(Continued)

OTHER PUBLICATIONS

International Search Report issued in corresponding International Application No. PCT/JP2020/029498 mailed Sep. 24, 2020 (5 pages).
(Continued)

*Primary Examiner* — Arti Singh-Pandey
(74) *Attorney, Agent, or Firm* — Osha Bergman Watanabe & Burton LLP

(57) ABSTRACT

A flame-retardant fiber composite includes an acrylic fiber A containing an acrylic copolymer and an aramid fiber. The acrylic fiber A is substantially free of an antimony compound, and the flame-retardant fiber composite forms a surface-foamed char layer when burned. A flame-retardant work clothing includes the flame-retardant acrylic fiber. A highly flame-retardant fiber composite and highly flame-retardant work clothing include an acrylic fiber, and are capable of exhibiting high flame retardancy while suppressing environmental impacts caused by a flame retardant.

7 Claims, 1 Drawing Sheet

(52) U.S. Cl.
CPC .... *D10B 2321/08* (2013.01); *D10B 2321/101* (2013.01); *D10B 2331/021* (2013.01); *D10B 2331/04* (2013.01)

(56) References Cited

U.S. PATENT DOCUMENTS

| | | | |
|---|---|---|---|
| 4,863,797 | A | 9/1989 | Ichibori et al. |
| 5,208,105 | A | 5/1993 | Ichibori et al. |
| 2010/0299816 | A1 | 12/2010 | Zhu |
| 2010/0299817 | A1 | 12/2010 | Zhu |

FOREIGN PATENT DOCUMENTS

| | | | |
|---|---|---|---|
| JP | S54-36702 | B2 | 11/1979 |
| JP | H04-18050 | B2 | 3/1992 |
| JP | 2005314817 | A | 11/2005 |
| JP | 2007-270410 | A | 10/2007 |
| JP | 2012-528954 | A | 11/2012 |
| WO | 2010/141554 | A1 | 12/2010 |

OTHER PUBLICATIONS

Written Opinion issued in corresponding International Application No. PCT/JP2020/029498 mailed Sep. 24, 2020 (4 pages).
Extended European Search Report issued in European Patent Application No. 20863733.0, dated Aug. 31, 2023 (9 Pages).

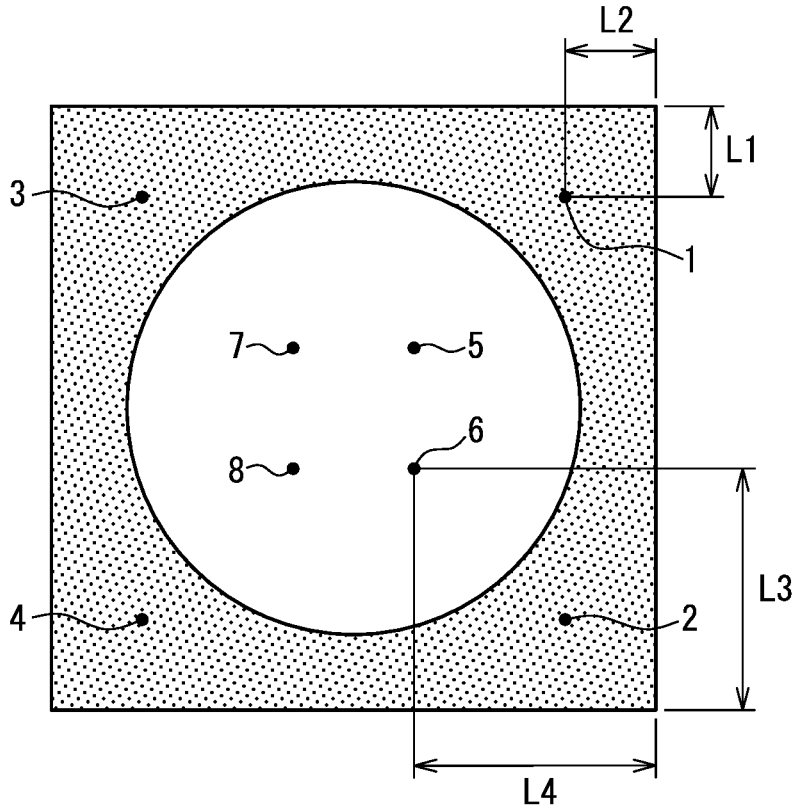
L2
L1
3
1
7
5
6
8
L3
4
2
L4

FLAME-RETARDANT FIBER COMPOSITE AND FLAME-RETARDANT WORKING CLOTHES

TECHNICAL FIELD

One or more embodiments of the present invention relate to a flame-retardant fiber composite and flame-retardant work clothing, each including an acrylic fiber.

BACKGROUND

Conventionally, in a flame-retardant fiber composite including a halogen-containing fiber such as an acrylic fiber, the halogen-containing fiber typically contains about 1 to 50 parts by mass of an antimony compound as a flame retardant (for example, Patent Document 1). Also, as a compound that imparts flame retardancy to halogen-containing fibers, not only an antimony compound but also a zinc stannate compound has been used (for example, Patent Document 2).

PATENT DOCUMENTS

Patent Document 1: JP H4(1992)-18050A

Patent Document 2: JP 2007-270410A

However, use of an antimony compound or a zinc stannate compound gives rise to concern about environmental impacts caused when these compounds are eluted or emitted.

One or more embodiments of the present invention provide a flame-retardant fiber composite and flame-retardant work clothing, each including an acrylic fiber and capable of exhibiting high flame retardancy while suppressing environmental impacts caused by a flame retardant.

SUMMARY

One or more embodiments of the present invention relate to a flame-retardant fiber composite including: an acrylic fiber A contains an acrylic copolymer; and an aramid fiber, wherein the acrylic fiber A is substantially free of an antimony compound, and the flame-retardant fiber composite forms a surface-foamed char layer when burned.

One or more embodiments of the present invention relate to flame-retardant work clothing including: the flame-retardant fiber composite.

One or more embodiments of the present invention can provide a highly flame-retardant fiber composite and highly flame-retardant work clothing, each including an acrylic fiber and capable of exhibiting high flame retardancy while suppressing environmental impacts caused by a flame retardant.

BRIEF DESCRIPTION OF THE DRAWINGS

FIG. 1 is a schematic view illustrating measurement points for measuring the thickness of a burn test sample.

DETAILED DESCRIPTION

The inventors of one or more embodiments of the present invention have conducted in-depth studies in order to improve the flame retardancy of a fiber composite including an acrylic fiber while suppressing environmental impacts caused by a flame retardant. As a result, the inventors found that a fiber composite that includes an acrylic fiber contains an acrylic copolymer and an aramid fiber and is adapted such that the fiber composite forms a surface-foamed char layer when burned can exhibit high flame retardancy without using a flame retardant, such as an antimony compound or a zinc stannate compound, that may influence the environment when the flame retardant is eluted or emitted.

In particular, it was surprisingly found that, when a copolymer of acrylonitrile and vinyl chloride is selected and used as the acrylic copolymer and magnesium oxide is selected as a flame retardant and blended in a specific blended amount, the fiber composite including the acrylic fiber contains this acrylic copolymer and the aramid fiber can easily form a surface-foamed char layer when burned and thus exhibits high flame retardancy. Although the mechanism thereof has not been clarified, the reason for this is presumed as follows: use of the acrylic fiber contains the copolymer of acrylonitrile and vinyl chloride in the fiber composite allows, when the fiber composite is burned, the fiber composite to easily forms a surface-foamed char layer after the acrylic fiber containing the magnesium oxide has melted, whereby the flame retardancy is enhanced.

In the flame-retardant fiber composite according to one or more embodiments of the present invention, whether the flame-retardant fiber composite "forms a surface-foamed char layer when burned" can be checked in the following manner, for example.

Method of Evaluating Surface-Foamed Char Layer (Evaluation of Flame Retardancy)

(1) Preparation of Burn Test Sample

As a burn test sample, a piece of 20 cm in length×20 cm in width×2 mm in thickness is cut out from the fiber composite.

(2) Burn Test

A perlite board having dimensions of 20 cm in length×20 cm in width×1 cm in thickness and provided with a hole having a diameter of 15 cm at a central portion thereof is prepared. The burn test sample is set on the perlite board, and four sides of the burn test sample are fixed with clips in order to prevent the sample from shrinking when heated. Then, the perlite board provided with the burn test sample is set above an industrial gas stove (PA-10H-2) manufactured by Paloma Co., Ltd. with the surface of the burn test sample facing up. The perlite board is disposed at a position spaced apart from the burner face by 40 mm with the center of the sample aligned with the center of the burner. In this state, the burn test sample is heated. Propane with a purity of 99% or more is used as a fuel gas, the flame height is set to 25 mm, and the contact time of the burn test sample with flames is set to 120 seconds.

(3) After the Burn Test, the Condition of a Char Coating on the Surface of the Burn Test Sample is evaluated according to the Following Criteria.

A: The char coating is well formed; the char coating has no cracks or through-holes.

B: The char coating is defectively formed; the char coating has a crack(s).

C: The char coating is defectively formed; the char coating has a through-hole(s).

(4) The Thickness of the Burn Test Sample is measured Before and After the Burn Test to calculate the Thickness Change Ratio.

The thickness of the burn test sample before the burn test is determined by measuring the thicknesses at four points 1, 2, 3, and 4 each located at distances L1 and L2 of 3 cm from the respective edges of the sample as shown in FIG. 1, and then calculating the average value of the thus-measured thicknesses.

The thickness of the burn test sample after the burn test is determined by measuring the thicknesses at four points 5, 6, 7, and 8 each located at distances L3 and L4 of 8 cm from the respective edges of the sample as shown in FIG. 1, and then calculating the average value of the thus-measured thicknesses.

$$\text{Thickness change ratio (\%)}=(Hb-Ha)/Ha\times 100\%$$

Ha is the thickness of the burn test sample before the burn test, and Hb is the thickness of the burn test sample after the burn test.

(5) Formation of Surface-Foamed Char Layer

When the condition of the char coating on the surface is evaluated as A and the thickness change ratio of the burn test sample before and after the burn test is from −15% to 15%, it means that a surface-foamed char layer has been formed.

When the thickness change ratio is less than −15%, it means that a surface-foamed char layer has not been formed owing to excessive melting of the fibers. When the thickness change ratio is more than 15%, it means that swelling of the char layer has occurred without causing foaming.

In one or more embodiments of the present invention, a flame-retardant fiber composite includes an acrylic fiber A contains an acrylic copolymer and an aramid fiber. The flame-retardant fiber composite "forms a surface-foamed char layer when burned", in other words, forms a coating resulting from intumescence when burned, thereby blocking the supply of oxygen and conduction of heat. Thus, the flame-retardant fiber composite exhibits high flame retardancy.

In one or more embodiments of the present invention, the acrylic copolymer may contain 20 to 85 mass % of acrylonitrile and 15 to 80 mass % of vinyl chloride, or 30 to 70 mass % of acrylonitrile, 30 to 70 mass % of vinyl chloride, and 0 to 10 mass % of one or more other viny monomers copolymerizable with these components, or 40 to 70 mass % of acrylonitrile, 30 to 60 mass % of vinyl chloride, and 0 to 3 mass % of one or more other vinyl monomers copolymerizable with these components, with the acrylic copolymer taken as 100 mass %. When the content of the acrylonitrile is in the above-described range, the flame-retardant fiber composite exhibits favorable heat resistance. When the content of the vinyl chloride is in the above-described range, the flame-retardant fiber composite exhibits favorable flame retardancy.

Examples of the above-described other copolymerizable vinyl monomers include, but not particularly limited to: unsaturated carboxylic acids typified by acrylic acids and methacrylic acids, as well as salts thereof esters of unsaturated carboxylic acids, typified by methacrylic esters (such as methyl methacrylate), glycidyl methacrylate and the like; vinyl esters typified by vinyl acetate and vinyl butyrate; and sulfonic acid-containing monomers. Examples of the above-described sulfonic acid-containing monomers include, but not particularly limited to, allylsulfonic acid, methallylsulfonic acid, styrenesulfonic acid, isoprenesulfonic acid, and 2-acrylamide-2-methylpropanesulfonic acid, as well as metal salts, such as sodium salts, and amine salts thereof. One of these other copolymerizable vinyl monomers may be used alone, or two or more of them may be used in combination.

The above-described acrylic copolymer can be obtained by a known polymerization method such as bulk polymerization, suspension polymerization, emulsion polymerization, or solution polymerization. Of these, emulsion polymerization or solution polymerization is preferable from industrial standpoints.

In one or more embodiments of the present invention, the acrylic fiber A may contain 3 parts by mass or more, 4 parts by mass or more, or 5 parts by mass or more of magnesium oxide, with respect to 100 parts by mass of the acrylic copolymer, from the viewpoint of allowing the fiber composite to easily form a surface-foamed char layer when burned. In one or more embodiments of the present invention, the acrylic fiber A may contain 20 parts by mass or less, 15 parts by mass or less, or 10 parts by mass or less of magnesium oxide, with respect to 100 parts by mass of the acrylic copolymer, from the viewpoint of the strength, spinnability, stain inhibition, dye-affinity, and the like.

In one or more embodiments of the present invention, the acrylic fiber A may have a limiting oxygen index (LOI) of 30 or more, 35 or more, or 40 or more, from the viewpoint of providing excellent flame retardancy. In one or more embodiments of the present invention, LOI can be measured in the following manner.

Method for Measuring LOI 2 g of a fiber (cotton) was taken and divided equally into eight pieces, which are then formed into eight twisted fiber bundles of about 6 cm in length. The thus-obtained sample is set upright in a holder equipped in an oxygen index type flammability tester (Suga Test Instrument Co. Ltd.; ON-1M), and the minimum oxygen concentration required for allowing 5 cm of the sample to keep burning was measured as the LOI value. The larger the LOI value, the less the sample is liable to burn and the higher the flame retardancy.

In one or more embodiments of the present invention, the acrylic fiber A is substantially free of an antimony compound. In the present disclosure, the state of being "substantially free of an antimony compound" means the state where an antimony compound is not intentionally contained, and accordingly, the state where an antimony compound is contained as a contaminant or the like is considered as being "substantially free of an antimony compound".

In one or more embodiments of the present invention, the acrylic fiber A may be substantially free of a zinc stannate compound. In the present disclosure, the state of being "substantially free of a zinc stannate compound" means the state where a zinc stannate compound is not intentionally contained, and accordingly, the state where a zinc stannate compound is contained as a contaminant or the like is considered as being "substantially free of a zinc stannate compound".

In one or more embodiments of the present invention, the acrylic fiber A may contain, when necessary, a flame retardant that is other than magnesium oxide but likewise does not give rise to concern about environmental impacts caused when it is eluted or emitted. In one or more embodiments of the present invention, the acrylic fiber A may contain one or more other additives such as an antistatic agent, a thermal coloration inhibitor, a light resistance improver, a whiteness improver, a devitrification inhibitor, and a colorant, when necessary.

In one or more embodiments of the present invention, the acrylic fiber A may have a single fiber strength of 1.0 to 4.0 cN/dtex or 1.5 to 3.5 cN/dtex, from the viewpoint of durability, for example. In one or more embodiments of the present invention, the acrylic fiber A may have an elongation of 20% to 40% or 20% to 30%, from the viewpoint of practical utility, for example. In one or more embodiments of the present invention, the single fiber strength and the elongation can be measured in a manner that complies with JIS L 1015.

In one or more embodiments of the present invention, either a short fiber or a long fiber may be used as the acrylic fiber A, and which of the fibers should be used can be selected as appropriate depending on the method of use. The single fiber fineness, which is selected as appropriate depending on the intended use of a fiber composite to be used, may be 1 to 50 dtex, 1.5 to 30 dtex, or 1.7 to 15 dtex. The cut length is selected as appropriate depending on the intended use of the fiber composite. For example, a short cut fiber (fiber length: 0.1 to 5 mm), a short fiber (fiber length: 38 to 128 mm), or a long fiber that is not cut at all (filament fiber) can be used.

In one or more embodiments of the present invention, the production method of the acrylic fiber A is not limited to particular methods. Preferably, the acrylic fiber A can be produced by spinning a composition that contains magnesium oxide and an acrylic copolymer containing acrylonitrile and vinyl chloride and then heat-treating the resulting spun composition. Specifically, the above procedure can be carried out by a known method such as a wet spinning method, a dry spinning method, and a dry-wet spinning method. For example, in the case of a wet spinning method, the acrylic fiber can be produced in the same manner as in the case of producing a commonly used acrylic fiber, except that a spinning dope obtained by dissolving the above-described acrylic copolymer in an organic solvent and then adding magnesium oxide thereto is used. Specifically, the acrylic fiber can be produced by extruding the above-described spinning dope into a coagulation bath through a nozzle to coagulate it, then subjecting it to stretching, washing with water, drying, heat-treating, crimping (when necessary), and cutting. Examples of the organic solvent include dimethylformamide, dimethylacetamide, acetone, a rhodan salt aqueous solution, dimethyl sulfoxide, and a nitric acid aqueous solution.

From the viewpoint of allowing the magnesium oxide to be easily dispersed in the acrylic fiber, the average particle diameter of the magnesium oxide may be 3 μm or less or 2 μm or less, but not particularly limited thereto. Further, from the viewpoint of handleability and availability, the average particle diameter of the magnesium oxide may be 0.01 μm or more or 0.1 μm or more, but not particularly limited thereto. In one or more embodiments of the present invention, the average particle size of magnesium oxide in the form of powder can be measured by a laser diffraction method, and the average particle diameter of magnesium oxide in the form of a dispersion (liquid dispersion) obtained by dispersing it in water or an organic solvent can be measured by a laser diffraction method or a dynamic light scattering method.

In one or more embodiments of the present invention, the aramid fiber may be a para-aramid fiber or a meta-aramid fiber.

In one or more embodiments of the present invention, from the viewpoint of flame retardancy, the flame-retardant fiber composite may contain 5 to 95 mass % of the acrylic fiber A and 5 to 95 mass % of the aramid fiber, 10 to 90 mass % of the acrylic fiber A and 10 to 90 mass % of the aramid fiber, 30 to 90 mass % of the acrylic fiber A and 10 to 70 mass % of the aramid fiber, 50 to 90 mass % of the acrylic fiber A and 10 to 50 mass % of the aramid fiber, or 80 to 90 mass % of the acrylic fiber A and 10 to 20 mass % of the aramid fiber, but the contents of the acrylic fiber A and the aramid fiber are not limited thereto.

In one or more embodiments of the present invention, in addition to the acrylic fiber A and the aramid fiber, one or more other fibers, which are not limited to particular types of fibers, may be further contained when necessary to the extent that the effect of one or more embodiments of the present invention is not impaired. Examples of the other fibers include natural fibers, regenerated fibers, and other synthetic fibers.

Examples of the natural fibers include: natural cellulose fibers such as cotton fibers, kapok fibers, linen fibers, hemp fibers, ramie fibers, jute fibers, Manila hemp fibers, and kenaf fibers; and natural animal fibers such as wool fibers, mohair fibers, cashmere fibers, camel fibers, alpaca fibers, angora fibers, and silk fibers.

Examples of the regenerated fibers include: regenerated cellulose fibers such as rayon, polynosic, cupra, and lyocell; regenerated collagen fibers; regenerated protein fibers; cellulose acetate fibers; and promix fibers.

Examples of the synthetic fibers include polyester fibers, polyamide fibers, polylactic acid fibers, acrylic fibers, polyolefin fibers, polyvinyl alcohol fibers, polyvinyl chloride fibers, polyvinylidene chloride fibers, polychlal fibers, polyethylene fibers, polyurethane fibers, polyoxymethylene fibers, polytetrafluoroethylene fibers, benzoate fibers, polyphenylene sulfide fibers, polyetheretherketone fibers, polybenzazole fibers, polyimide fibers, and polyamide-imide fibers. In addition, flame-retardant polyester, polyethylene naphthalate fibers, melamine fibers, acrylate fibers, polybenzoxide fibers, and the like also can be used as the synthetic fibers. Other examples of the synthetic fibers include oxidized acrylic fibers, carbon fibers, glass fibers, and activated carbon fibers.

Of these, from the viewpoint of flame retardancy, cost, texture, and the like, natural fibers, regenerated cellulose fibers, polyester fibers, and melamine fibers are preferable, one or more fibers selected from the group consisting of wool fibers, cellulose fibers, and polyester fibers are more preferable, and polyester fibers are still more preferable.

In one or more embodiments of the present invention, the flame-retardant fiber composite may include, for example, 90 mass % or less, 85 mass % or less, 65 mass % or less, or 60 mass % or less of one or more other fibers as long as the flame-retardant fiber composite forms a surface-foamed char layer when burned. Specifically, in one or more embodiments of the present invention, the flame-retardant fiber composite may include, for example, 5 to 95 mass % of the acrylic fiber A, 5 to 95 mass % of the aramid fiber, and 0 to 90 mass % of one or more other fibers, 10 to 90 mass % of the acrylic fiber A, 5 to 90 mass % of the aramid fiber, and 0 to 85 mass % of one or more other fibers, 30 to 70 mass % of the acrylic fiber A, 5 to 30 mass % of the aramid fiber, and 0 to 65 mass % of one or more other fibers, or 35 to 70 mass % of the acrylic fiber A, 5 to 20 mass % of the aramid fiber, and 10 to 60 mass % of one or more other fibers.

In one or more embodiments of the present invention, examples of the flame-retardant fiber composite include those obtained by fiber blending, mixed spinning, and filament blending, conjugated yarns such as paralleled yarns, folded yarns, and sheath-core yarns, and those obtained by mixed weaving, mixed knitting, and laminating. The specific form of the flame-retardant fiber composite may be cotton for use as stuffing or the like, a nonwoven fabric, a woven fabric, a knitted fabric, a braided fabric, or the like.

Examples of the cotton for use as stuffing and the like include opened cotton, ball-like cotton, webs, and molded cotton.

Examples of the nonwoven fabric include wet-laid nonwoven fabrics, carded nonwoven fabrics, air-laid nonwoven fabrics, thermal bonded nonwoven fabrics, chemical bonded nonwoven fabrics, needle-punched nonwoven fabrics, hydro-entangled nonwoven fabrics, and stitch bonded nonwoven fabrics. Thermal bonded nonwoven fabrics and needle-punched nonwoven fabrics are industrially inexpensive. The nonwoven fabric may have any of a structure that is uniform in the thickness, width, and length directions, a distinctive laminate structure, and an indistinct laminated structure.

Examples of the woven fabric include plain weave fabrics, twill weave fabrics, satin weave fabrics, irregular plain weave fabrics, irregular twill weave fabrics, irregular satin weave fabrics, fancy weave fabrics, Jacquard weave fabrics, woven fabrics using two or more types of yarn for either one of the warp and the weft, double weave fabrics, multiple weave fabrics, warp pile woven fabrics, weft pile woven fabrics, and leno weave fabrics. Plain weave fabrics, satin weave fabrics, and Jacquard weave fabrics exhibit excellent texture, strength, and the like as commercial products.

Examples of the knitted fabric include circular knitted fabrics, weft knitted fabrics, warp knitted fabrics, and pile knitted fabrics, and examples thereof include plain stitch fabrics, jersey stitch fabrics, rib stitch fabrics, smooth knitted fabrics (interlock stitch fabrics), elastic rib stitch fabrics, purl stitch fabrics, denbigh stitch structures, cord stitch structures, atlas stitch structures, chain stitch structures, and laid-in structures. Of these, jersey stitch fabrics and rib stitch fabrics are excellent in texture as commercial products.

In one or more embodiments of the present invention, a textile product (application) includes the above-described flame-retardant fiber composite, and examples thereof include the following products.

(1) Clothing and Materials of Daily Necessities

Clothes (including jackets, underwear, sweaters, vests, trousers, and the like), gloves, socks, mufflers, hats, bedding, pillows, cushions, stuffed toys, and the like (2) Special Purpose Clothing Protective clothing, firefighting clothing, work clothing, cold weather clothing, and the like (3) Interior Materials Chair upholstery, curtains, wallpaper, carpets, and the like (4) Industrial Materials Filters, flame resistant stuffing, lining materials, and the like The flame-retardant fiber composite forms a surface-foamed char layer when burned, whereby it can block the supply of oxygen and conduction of heat. Accordingly, by using the flame-retardant fiber composite as a flame-shielding fabric to produce a flame-retardant upholstered product such as bedding or furniture (for example, a bed mattress, pillow, comforter, bedspread, mattress pad, futon, cushion, and chair), the flame-retardant fiber composite can impart high flame retardancy to the product. The bed mattress may be, for example, a pocket coil mattress or a box coil mattress, each having metal coils inside, or a mattress having an insulator composed of a foamed styrene resin or a foamed urethane resin inside or having a low resilience urethane inside. Owing to the flame retardancy of the flame-retardant fiber composite, fire can be prevented from spreading to the structure inside the mattress. The chair may be, for example, a chair used indoors, such as a stool, bench, side chair, armchair, lounge chair/sofa, seat unit (sectional chair, separate chair), rocking chair, folding chair, stacking chair, or swivel chair, or alternatively, a chair used outdoors as a vehicle seat or the like, such as an automobile seat, ship seat, aircraft seat, or train seat.

In the flame-retardant upholstered product, the flame-shielding fabric may be used in the form of a woven fabric or knitted fabric as a surface fabric of the product, or may be used in the form of a woven fabric, knitted fabric, or nonwoven fabric and interposed between a surface fabric of the product and the internal structure such as, for example, urethane foam or stuffing cotton. When the above-described flame-shielding fabric is used as the surface fabric, the flame-shielding fabric may be used in place of a conventional surface fabric. When the woven fabric or knitted fabric is interposed between the surface fabric and the internal structure, this may be achieved by placing the flame-shielding fabric together with the surface fabric just like placing two surface fabrics on the product or by covering the internal structure with the flame-shielding fabric. In the case where the flame-shielding fabric is interposed between the surface fabric and the internal structure, it is preferable to upholster the whole internal structure with the surface fabric in the state where the outside of at least a portion of the internal structure to be in contact with the surface fabric is surely covered with the flame-shielding fabric.

The flame-shielding fabric can be made of the following flame-retardant fiber composites, for example.

(1) A flame-retardant fiber composite including 35 to 70 mass % of an acrylic fiber A, 5 to 20 mass % of an aramid fiber, and 10 to 60 mass % of a wool fiber (2) Aflame-retardant fiber composite including 35 to 80 mass % of an acrylic fiber A, 5 to 20 mass % of an aramid fiber, and 10 to 60 mass % of a natural cellulose fiber and/or a regenerated cellulose fiber (3) A flame-retardant fiber composite including 45 to 70 mass % of an acrylic fiber A, 15 to 20 mass % of an aramid fiber, and 10 to 40 mass % of a polyester fiber The flame-retardant fiber composite forms a surface-foamed char layer when burned, whereby it can block the supply of oxygen and conduction of heat. Accordingly, for example, work clothing produced using the flame-retardant fiber composite has high flame retardancy.

The flame-retardant work clothing can be made of the following flame-retardant fiber composites, for example.

(1) Aflame-retardant fiber composite including 35 to 70 mass % of an acrylic fiber A, 5 to 20 mass % of an aramid fiber, and 10 to 60 mass % of a wool fiber (2) Aflame-retardant fiber composite including 35 to 70 mass % of an acrylic fiber A, 5 to 20 mass % of an aramid fiber, and 10 to 60 mass % of a natural cellulose fiber and/or a regenerated cellulose fiber (3) A flame-retardant fiber composite including 45 to 70 mass % of an acrylic fiber A, 15 to 20 mass % of an aramid fiber, and 10 to 40 mass % of a polyester fiber

EXAMPLES

One or more embodiments of the present invention will be described more specifically with reference to examples. It is to be noted, however, that one or more embodiments of the present invention are not limited to the following examples.

Example 1

Production of Acrylic Fiber

An acrylic copolymer containing 50 mass % of acrylonitrile, 49.5 mass % of vinyl chloride, and 0.5 mass % of sodium p-styrenesulfonate was obtained through emulsion polymerization of the acrylonitrile, vinyl chloride, and sodium p-styrenesulfonate, and the thus-obtained acrylic copolymer was dissolved in dimethylformamide to yield a resin concentration of 30 mass %. To the resulting resin solution, 5 parts by mass of magnesium oxide (MgO, Kyowa Chemical Industry Co., Ltd., product name "500 04R") was added with respect to 100 parts by mass of the resin mass, thereby obtaining a spinning dope. The magnesium oxide was used in the form of a magnesium oxide dispersion prepared beforehand by adding the magnesium oxide to dimethylformamide to yield a concentration of 30 mass % and uniformly dispersing the magnesium oxide therein. The average particle diameter of the magnesium oxide in the magnesium oxide dispersion was measured by a laser diffraction method and found to be 2 μm or less. The obtained spinning dope was coagulated by being extruded into a 50 mass % dimethylformamide aqueous solution through a nozzle provided with 300 nozzle holes having a diameter of 0.08 mm, and then washed with water. Thereafter, it was dried at 120° C., then stretched 3 times, and further heat-treated at 145° C. for 5 minutes. As a result, an acrylic fiber was obtained. The thus-obtained acrylic fiber of Example 1 had a single fiber fineness of 1.7 dtex, a strength of 2.5 cN/dtex, an elongation of 26%, and a cut length of 51 mm. In each example and comparative example, the fineness, strength, and elongation of an acrylic fiber were measured on the basis of JIS L 1015.

Production of Fiber Composite 90 parts by mass of the acrylic fiber A obtained through the above-described process and 10 parts by mass of a para-aramid fiber (Yantai Tayho Advanced Materials Co., Ltd., Taparan®, single fiber fineness: 1.67 dtex, fiber length: 51 mm) were blended together, and the resulting fiber blend was opened with a card. Thereafter, a nonwoven fabric having a basis weight shown in Table 1 was produced by a needle punching method.

Example 2

Production of Fiber Composite 50 parts by mass of an acrylic fiber A obtained in the same manner as in Example 1, 10 parts by mass of a para-aramid fiber (Yantai Tayho Advanced Materials Co., Ltd., Taparan®, single fiber fineness: 1.67 dtex, fiber length: 51 mm), and 40 parts by mass of a regenerated cellulose fiber (Lenzing AG, Tencel, single fiber fineness: 1.3 dtex, fiber length: 38 mm) were blended together, and the resulting fiber blend was opened with a card. Thereafter, a nonwoven fabric having a basis weight shown in Table 1 was produced by a needle punching method.

Example 3

Production of Acrylic Fiber

An acrylic fiber A was produced in the same manner as in Example 1, except that a spinning dope was prepared by adding 10 parts by mass of magnesium oxide with respect to 100 parts by mass of the resin mass.

Production of Fiber Composite

A nonwoven fabric having a basis weight shown in Table 1 was produced in the same manner as in Example 1, except that the acrylic fiber A obtained through the above-described process was used.

Comparative Example 1

Production of Acrylic Fiber

An acrylic fiber was produced in the same manner as in Example 1, except that a spinning dope was obtained by adding magnesium oxide to a solution of an acrylic copolymer such that 2 parts by mass of magnesium oxide was contained with respect to 100 parts by mass of the acrylic copolymer. The thus-obtained acrylic fiber had a single fiber fineness of 1.71 dtex, a strength of 2.58 cN/dtex, an elongation of 27.4%, and a cut length of 51 mm.

Production of Fiber Composite

A nonwoven fabric having a basis weight shown in Table 1 was produced in the same manner as in Example 1, except that the acrylic fiber obtained through the above-described process was used.

Comparative Example 2

Production of Acrylic Fiber

An acrylic fiber was produced in the same manner as in Example 1, except that a spinning dope was obtained by adding, instead of magnesium oxide, antimony trioxide to a solution of an acrylic copolymer such that 10 parts by mass of the antimony trioxide was contained with respect to 100 parts by mass of the acrylic copolymer. The antimony trioxide was used in the form of an antimony trioxide dispersion prepared beforehand by adding the antimony trioxide to dimethylformamide to yield a concentration of 30 mass % and uniformly dispersing the antimony trioxide therein. The average particle diameter of the antimony trioxide in the antimony trioxide dispersion was measured by a laser diffraction method and found to be 2 μm or less. The thus-obtained acrylic fiber had a single fiber fineness of 1.76 dtex, a strength of 2.8 cN/dtex, an elongation of 29.2%, and a cut length of 51 mm.

Production of Fiber Composite

A nonwoven fabric having a basis weight shown in Table 1 was produced in the same manner as in Example 1, except that the acrylic fiber obtained through the above-described process was used.

Comparative Example 3

Production of Acrylic Fiber

An acrylic fiber was obtained in the same manner as in Example 1, except that an acrylic copolymer containing 50 mass % of acrylonitrile, 49.5 mass % of vinylidene chloride, and 0.5 mass % of sodium p-styrenesulfonate, obtained through emulsion polymerization of the acrylonitrile, vinyl chloride, and sodium p-styrenesulfonate, was used. The thus-obtained acrylic fiber had a single fiber fineness of 1.78 dtex, a strength of 1.97 cN/dtex, an elongation of 33.3%, and a cut length of 51 mm.

Production of Fiber Composite

A nonwoven fabric having a basis weight shown in Table 1 was produced in the same manner as in Example 1, except that the acrylic fiber obtained through the above-described process was used.

Comparative Example 4

Production of Acrylic Fiber

An acrylic fiber was produced in the same manner as in Comparative Example 3, except that a spinning dope was obtained by adding, instead of magnesium oxide, antimony trioxide to a solution of an acrylic copolymer such that 10 parts by mass of the antimony trioxide was contained with respect to 100 parts by mass of the acrylic copolymer. The antimony trioxide was used in the form of an antimony trioxide dispersion prepared beforehand by adding the antimony trioxide to dimethylformamide to yield a concentration of 30 mass % and uniformly dispersing the antimony trioxide therein. The average particle diameter of the antimony trioxide in the antimony trioxide dispersion was measured by a laser diffraction method and found to be 2 μm or less. The thus-obtained acrylic fiber had a single fiber fineness of 1.75 dtex, a strength of 1.66 cN/dtex, an elongation of 22.9%, and a cut length of 51 mm.

Production of Fiber Composite

A nonwoven fabric having a basis weight shown in Table 1 was produced in the same manner as in Example 1, except that the acrylic fiber obtained through the above-described process was used.

Comparative Example 5

A nonwoven fabric having a basis weight shown in Table 1 was produced in the same manner as in Example 1, except that only the acrylic fiber produced in the same manner as in Example 1 was used in an amount of 100 parts by mass.

The flame retardancy of the fiber composite obtained in each of the examples and comparative examples was evaluated in the following manner. The results obtained are shown in Table 1 below.

Method of Evaluating Flame Retardancy

Method of Evaluating Surface-Foamed Char Layer>

(1) Preparation of Burn Test Sample

As a burn test sample, a piece of 20 cm in length×20 cm in width×2 mm in thickness was cut out from each fiber composite.

(2) Burn Test

Aperlite board having dimensions of 20 cm in length×20 cm in width×1 cm in thickness and provided with a hole having a diameter of 15 cm at a central portion thereof was prepared. The burn test sample was set on the perlite board, and four sides of the burn test sample were fixed with clips in order to prevent the sample from shrinking when heated. Then, the perlite board provided with the burn test sample was set above an industrial gas stove (PA-10H-2) manufactured by Paloma Co., Ltd. with the surface of the burn test sample facing up. The perlite board was disposed at a position spaced apart from the burner face by 40 mm with the center of the sample aligned with the center of the burner. In this state, the burn test sample was heated. Propane with a purity of 99% or more was used as a fuel gas, the flame height was set to 25 mm, and the contact time of the burn test sample with flames was set to 120 seconds.

(3) After the Burn Test, the Condition of a Char Coating on the Surface of the Burn Test Sample was evaluated according to the Following Criteria.

A: The char coating was well formed; the char coating had no cracks or through-holes.

B: The char coating was defectively formed; the char coating had a crack(s).

C: The char coating was defectively formed; the char coating had a through-hole(s).

(4) The Thickness of the Burn Test Sample was measured Before and After the Burn Test to Calculate the Thickness Change Ratio.

The thickness of the burn test sample before the burn test was determined by measuring the thicknesses at four points 1, 2, 3, and 4 each located at distances L1 and L2 of 3 cm from the respective edges of the sample as shown in FIG. 1, and then calculating the average value of the thus-measured thicknesses.

The thickness of the burn test sample after the burn test was determined by measuring the thicknesses at four points 5, 6, 7, and 8 each located at distances L3 and L4 of 8 cm from the respective edges of the sample as shown in FIG. 1, and then calculating the average value of the thus-measured thicknesses.

$$\text{Thickness change ratio (\%)} = (Hb - Ha)/Ha \times 100\%$$

Ha is the thickness of the burn test sample before the burn test, and Hb is the thickness of the burn test sample after the burn test.

(5) Formation of Surface-Foamed Char Layer

When the condition of the char coating on the surface was evaluated as A and the thickness change ratio of the burn test sample before and after the burn test was from −15% to 15%, it means that a surface-foamed char layer had been formed.

When the thickness change ratio was less than −15%, it means that a surface-foamed char layer had not been formed owing to excessive melting of the fibers. When the thickness change ratio was more than 15%, it means that swelling of the char layer had occurred without causing foaming.

TABLE 1

| | Basis Weight ($g/m^2$) | Condition of Char Coating on Surface | Thickness Change Ratio (%) | Formation of Surface-Foamed Char Layer |
|---|---|---|---|---|
| Example 1 | 225 | A | −1.6 | Formed |
| Example 2 | 284 | A | 12 | Formed |
| Example 3 | 270 | A | −6.3 | Formed |
| Comparative Example 1 | 207 | C | −18.5 | Not Formed |
| Comparative Example 2 | 238 | B | −38.6 | Not Formed |
| Comparative Example 3 | 289 | C | 20 | Not Formed |
| Comparative Example 4 | 226 | C | −13 | Not Formed |
| Comparative Example 5 | 200 | C | *Unmeasurable | Not Formed |

*Unmeasurable: The thickness could not be measured because no sample remained at burned sites after the burn test.

From the results shown in Table 1 above, it was found that the fiber composites of the examples had formed a surface-foamed char coating when burned and exhibited high flame retardancy. In contrast, the fiber composites of the comparative examples had not formed a surface-foamed char coating when burned and were inferior in flame retardancy.

One or more embodiments of the present invention can also be implemented in embodiments other than those described above without departing from the gist of one or more embodiments of the present invention. The embodiments disclosed in the present application are merely illustrative and by no means limit the present invention. The scope of one or more embodiments of the present invention is construed on the basis of the recitations in claims, and all changes that come within the range of equivalency of the claims are therefore intended to be embraced therein.

LIST OF REFERENCE NUMERALS

1, 2, 3, 4: Measurement points for measuring the thickness of a burn test sample before a burn test

5, 6, 7, 8: Measurement points for measuring the thickness of the burn test sample after the burn test Although the disclosure has been described with respect to only a limited number of embodiments, those skilled in the art, having benefit of this disclosure, will appreciate that various other embodiments may be devised without departing from the scope of the present disclosure. Accordingly, the scope of the invention should be limited only by the attached claims.

What is claimed is:

1. A flame-retardant fiber composite comprising:

an acrylic fiber A containing an acrylic copolymer; and an aramid fiber, wherein the acrylic fiber A is substantially free of an antimony compound, 3 parts by mass or more of magnesium oxide is contained with respect to 100 parts by mass of the acrylic copolymer, the flame-retardant fiber composite comprises 35 to 70 mass % of the acrylic fiber A, 5 to 20 mass % of the aramid fiber, and 10 to 60 mass % of other fibers, and the other fibers is one or more fibers selected from the group consisting of wool fibers, cellulose fibers, and polyester fibers, and the flame-retardant fiber composite forms a surface-foamed char layer when burned.

2. The flame-retardant fiber composite according to claim 1, wherein the acrylic copolymer contains 20 to 85 mass % of acrylonitrile and 15 to 80 mass % of vinyl chloride with the acrylic copolymer taken as 100 mass %.

3. The flame-retardant fiber composite according to claim 1, wherein the acrylic fiber A has a single fiber strength of 1.0 to 4.0 cN/dtex and an elongation of 20% to 40%.

4. The flame-retardant fiber composite according to claim 1, wherein the flame-retardant fiber composite comprises one or more selected from the group consisting of a non-woven fabric, a woven fabric, and a knitted fabric.

5. A flame-retardant work clothing comprising the flame-retardant fiber composite according to claim 1.

6. A flame-retardant fiber composite comprising:

an acrylic fiber A containing an acrylic copolymer; and an aramid fiber, wherein the acrylic fiber A is substantially free of an antimony compound, 3 parts by mass or more of magnesium oxide is contained with respect to 100 parts by mass of the acrylic copolymer, the flame-retardant fiber composite forms a surface-foamed char layer when burned, and the flame-retardant fiber composite comprises 50 to 95 mass % of the acrylic fiber A and 5 to 20 mass % of the aramid fiber.

7. A flame-retardant work clothing comprising the flame-retardant fiber composite according to claim 6.

* * * * *